United States Patent [19]

Diegel

[11] 4,193,560

[45] Mar. 18, 1980

[54] ADJUSTABLE WIDTH SPOOL

[76] Inventor: Herbert F. Diegel, 1524 E. Culver, Phoenix, Ariz. 85006

[21] Appl. No.: 31,004

[22] Filed: Apr. 18, 1979

[51] Int. Cl.[2] ..... B65H 75/18

[52] U.S. Cl. ..... 242/71.9

[58] Field of Search ..... 242/71.9, 71.8, 73, 242/116, 118.4, 118.5, 118.61, 118.7

[56] References Cited

U.S. PATENT DOCUMENTS

| | | | |
|---|---|---|---|
| 2,465,631 | 3/1949 | Bruestle | 242/118.5 |
| 3,017,133 | 1/1962 | Bowler | 242/71.9 |
| 3,081,960 | 3/1963 | Howe | 242/73 X |
| 3,987,975 | 10/1976 | Jackson | 242/71.8 |
| 4,101,095 | 7/1978 | Carter | 242/71.9 |

FOREIGN PATENT DOCUMENTS

| | | | |
|---|---|---|---|
| 1154390 | 10/1957 | France | 242/71.8 |

*Primary Examiner*—Edward J. McCarthy

*Attorney, Agent, or Firm*—Cahill, Sutton & Thomas

[57] ABSTRACT

A spool is formed having a pair of opposing flat circular plates each having a central opening therein for receiving a cylindrical shaft to be rotatably supported thereby. The distance measured axially along the supporting shaft between the flat plates is determined by the alignment of spacer pins extending perpendicularly from the opposing surface of one plate and corresponding openings in the other plate. The spacer ring also extends perpendicularly from the opposing surface of one of the plates toward the opposing surface of the second plate; a registration pin also extends from the opposing surface of one plate toward a plurality of openings provided therefor in the opposing plate. The axial distance between the plates therefore depends on which of the spacer pins are aligned with their corresponding opening, the registration always being aligned with one of the registration openings in the opposing plate.

8 Claims, 11 Drawing Figures

ADJUSTABLE WIDTH SPOOL

The present invention pertains to spools, and more particularly, spools for receiving and supporting a roll of flexible material.

There are enumerable uses for rolls of flexible materials such as tapes and foils of various kinds. While the present invention has applicability to a variety of such tapes and foils, it is specifically directed to the utilization of adhesively backed foil for use in dispensing apparatus of the type used in the stained glass industry. See for example co-pending application, Ser. No. 902,298, filed May 3, 1978 and entitled "METHOD AND APPARATUS FOR DISPENSING ADHESIVE-BACKED FOIL". In that application a foil dispenser is described wherein a spool or reel is mounted on the dispenser for receiving flexible foil to be dispensed through the apparatus. The foil is purchased in the manner similar to most tapes and foils, i.e., a cylindrical roll wherein the tape has been wound about a cardboard or plastic hub. The spool is adapted to receive the tape and the hub. However, in the apparatus described in the above identified application, it is important that the spool rotate as the foil is removed, rather than simply permitting the foil roll to rotate on the spool by itself.

As in many applications, the dispensing of rolls of foil in the stained glass industry also requires the accommodation of foils having different widths. It has therefore previously been necessary to have several spools, each of a different width, to accommodate the anticipated widths of the foil to be used. Various prior art structures have been proposed for variable width spools or reels. For example, many prior art designs incorporate complex, and therefore expensive, structures which are inappropriate to a low cost application. Still other prior art designs provide reel or spool width adjustments which are cumbersome to make and which are not sufficiently positive to permit rapid change without adjustment by the operator after each change.

It is therefore an object of the present invention to provide an adjustable width spool that can receive and support a roll of flexible material.

Another object of the present invention is to provide an adjustable width spool whose width can rapidly be changed to accommodate various predetermined widths of flexible material contained on rolls supported by the spool.

Still another object of the present invention is to provide an adjustable width spool that can receive and support a roll of flexible material while ensuring that the roll will rotate only with the spool and not independently of the spool.

These and other objects of the present invention will become apparent to those skilled in the art as the description thereof proceeds.

Briefly, and in accordance with the embodiment chosen for illustration, an adjustable width spool is formed from a pair of opposing flat plate or discs, each of which is provided with a central opening for receiving a cylindrical shaft to be rotatably supported thereby. One of the plates is provided with a spacer ring and a plurality of spacer pins extending substantially perpendicular from the face of the plate toward the opposing surface of the other plate. A registration pin is also provided and extends a greater distance from the surface of the first plate than the remaining pins or spacer ring. The second plate is provided with a plurality of openings for receiving the spacer pins when appropriately aligned; further, the second plate is provided with a plurality of openings adapted to receive the registration pin which always extends through one of the openings, regardless of the distance between the respective plates.

The present invention may more readily be described by reference to the accompanying drawings, in which.

Figure 1:
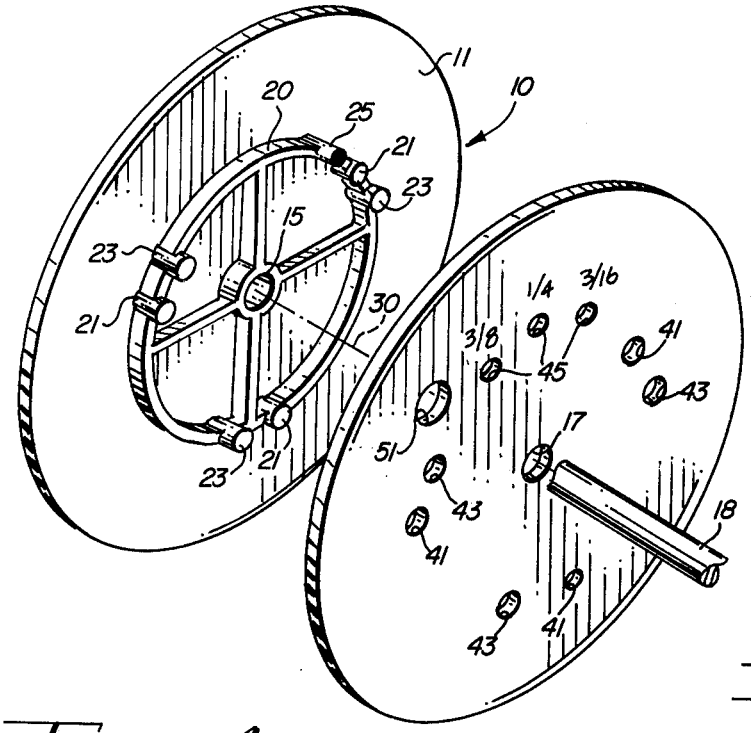
FIG. 1 is an exploded perspective view of an adjustable width spool constructed in accordance with the teachings of the present invention.
Figure 5:
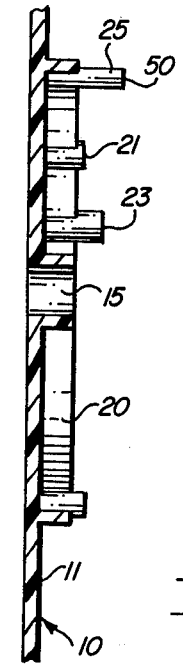
FIG. 5 is a cross-sectional view of a portion of the apparatus of FIG. 2 taken along line 5—5.
Figure 4:
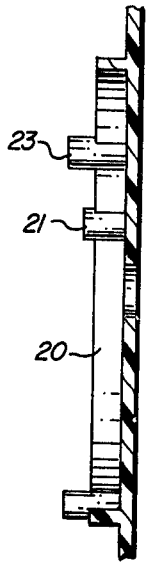
FIG. 4 is a cross-sectional view of a portion of the apparatus of FIG. 2 taken along line 4—4.
Figure 2:
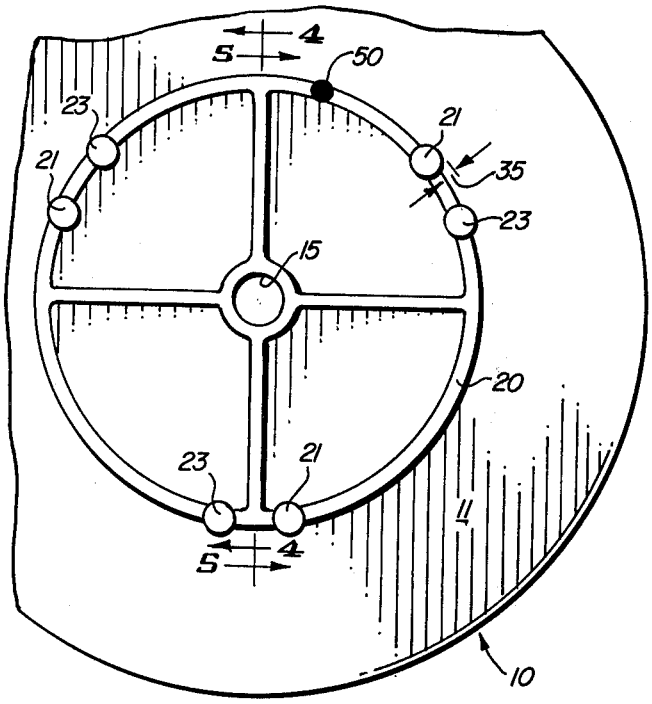
FIG. 2 is an elevational view, partly cut away, of the opposing surface of the first plate of FIG. 1.
Figure 3:
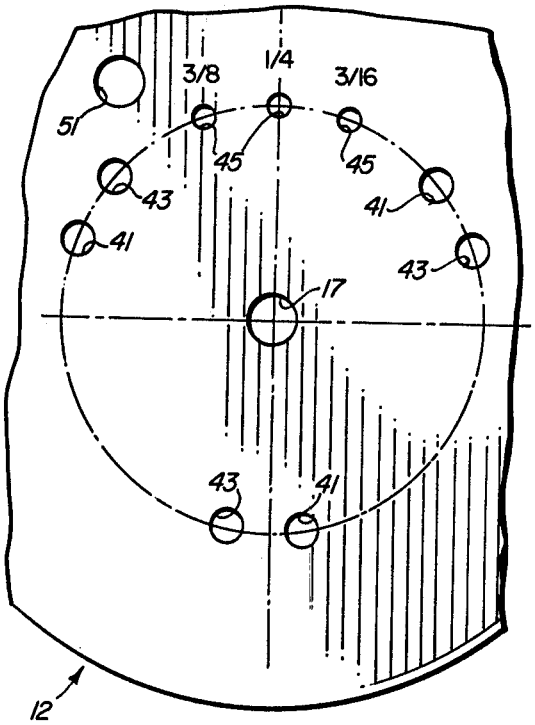
FIG. 3 is a front elevational view, partly cut away, of the opposing surface of the second plate of FIG. 1.

Referring now to FIGS. 1-5, the embodiment chosen for illustration is shown incorporating a first plate 10 having a surface 11 opposing a second plate 12. Both plates 10 and 12 have central openings 15 and 17 for receiving a cylindrical shaft 18 to be rotatably supported thereby. The two plates 10 and 12, when supported on the shaft 18, may be urged toward one another by any convenient means, such as a threaded nut or hub (not shown).

The first plate 10 includes a spacer ring 20 positioned concentrically to the cylindrical shaft 18 and extending a predetermined distance perpendicularly from the surface 11 toward the opposing surface of the second flat plate 12. The ring 20 is adapted to receive and support a roll of flexible material, such as tape or foil. As described previously, such rolls of flexible material generally having a cardboard or plastic hub over which the material is wound, which hub is intended to be slipped over the ring 20 to be supported thereby.

The plate 10 also includes a first plurality of spacer pins 21 which extend perpendicularly from the surface 11 toward the opposing surface of the second plate 12. The first plurality of pins 21 extends a predetermined distance from the surface 11 greater than the distance of extension of the ring 20. A second plurality of spacer pins 23 extends perpendicularly from the surface 11 toward the opposing surface of the second plate 12. The second plurality of spacer pins 21 extends a distance greater than the corresponding distance of the spacer ring 20 for the first plurality of spacer pins 21. A registration pin 25 also extends perpendicularly from the surface 11 toward the opposing surface of the second plate 12. The distance of extension of the registration pin 25 is greater than either the ring 20 or any of the other pins 21 or 23. In the embodiment chosen for illustrating, it may be noted that all of the pins 21, 23, and 25, extend the same radial distance from the axis 30 of the cylindrical shaft 18 and are positioned basically the same radial distance from the axis as the ring 20; however, the radially most distant surface of the pins is slightly greater than the radial distance of the radially most distant surface of the spacer ring 20. This slight difference is most clearly indicated in FIG. 2 by the distance 35. That is, the outer circumferential surface of the spacer ring 20 is interrupted slightly by the "bumps" or slight elevations caused by the spacer pins and the registration pin. This slight deformity in the otherwise circular circumference of the spacer ring 20 performs an important function. In many applications, it is desirable to prevent the roll of flexible material from turning on the spool or reel; in those applications, it is important that the spool turn with the roll and that means be provided to prevent independent rotation of either. The slight deformations in the exterior circumference of the spacer ring 20 caused by the spacer pins and registration pin, cause a slight deformation in the cardboard or plastic hub of the roll of flexible material as it is mounted upon the spool. This slight deformation increases the friction between the roll and the spool such that the roll is prevented from independently rotating. Thus, when a roll of foil or tape is mounted on the spool of the present invention, it effectively becomes "locked" to the spool to ensure that the spool rotates with the roll and that the two do not rotate relative to each other.

The second plate 12 incorporates a first plurality of spacer openings 41 corresponding in number to said first plurality of spacer pins 21 and positioned to permit the pins 21 to pass through the openings 41 when the pins and the openings are aligned. The plate 12 also includes a second plurality of openings 43 corresponding in number to the second plurality of spacer pins 23 and positioned to permit the pins 23 to pass through the openings 43 when the pins and openings are aligned. The alignment of the pins 21 with the openings 41 or the alignment of the pins 23 with the openings 43 is accomplished by rotating one of the plates 10 or 12 with respect to the other about the axis of rotation 30 of the cylindrical shaft 18. A plurality of registration openings 45 are provided to permit the registration pin 25 to pass therethrough. The registration pin may be aligned with and inserted into any one of the openings 45, depending on the desired width of the spool. As an example, the embodiment chosen for illustrate incorporates three registration openings 45 designated by the nominal widths of the spool when the registration pin is inserted in any of the holes. These registration openings 45 are designated "⅜", "¼", and "3/16". Thus, when the registration pin is inserted in any one of the registration openings 45, the width of the spool is adjusted to accommodate the corresponding foil or tape width indicated by the number positioned adjacent that registration opening.

Figure 6A:
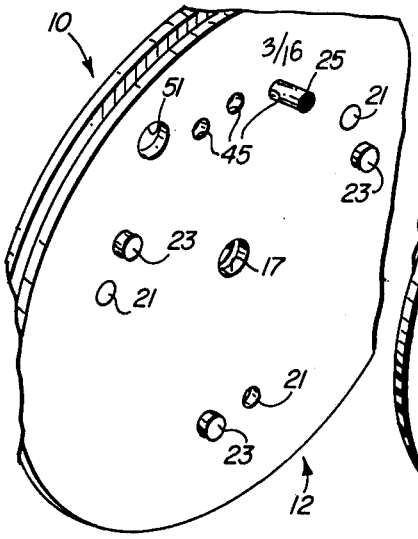
FIGS. 6A and 6B are a perspective view and a cross-sectional view of the adjustable spool of the present invention showing the spool set at a minimum width.
Figure 6B:
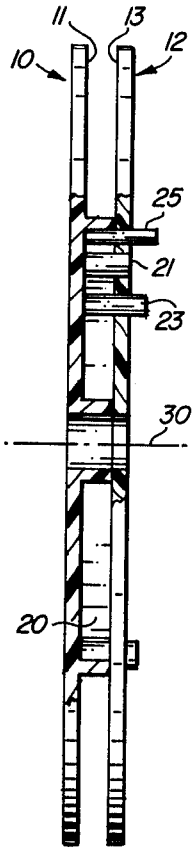

The adjustment of the width of the spool of the present invention may be described by reference to FIGS. 6A–8B. Referring first to FIGS. 6A and 6B, it may be seen that the plates 10 and 12 have been rotated about the axis 30 with respect to each other so as to align all of the spacer pins 21 and 23 with their corresponding openings 41 and 43. Thus, the ring 20 extending from the surface 11, comes into abutting contact with the opposing surface 13 of the plate 12. In this position, the registration pin 25 is aligned with the registration opening 45 adjacent the size designation "3/16". Thus, the spool is now in a position to accept and support a roll of tape or foil having a nominal width of 3/16 of an inch.

Figure 7A:
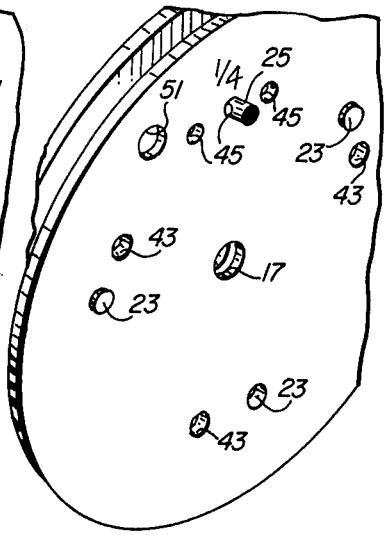
FIGS. 7A and 7B are a perspective view and a cross-sectional view of the adjustable spool of the present invention showing the spool set at an intermediate width.
Figure 7B:
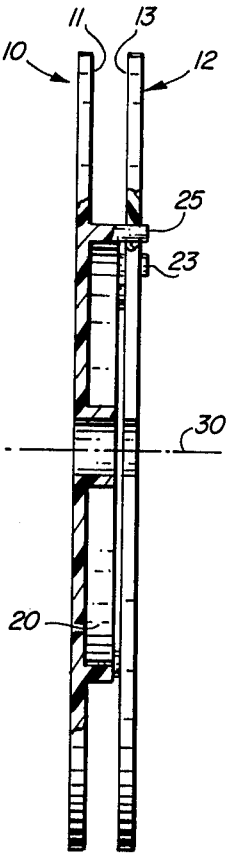

Referring now to FIGS. 7A and 7B, it may be seen that the plates 10 and 12 have been rotated with respect to each other about the axis 30 in a manner that has aligned the plurality of spacer pins 23 with the first plurality of openings 41; in so doing, we have caused the misalignment of the first plurality of spacer pins 21 with any of the openings in the plate 12. Accordingly, the first plurality of spacer pins 21 are now in abutting contact with the opposing surface 13 of the plate 12. The distance between the plates 10 and 12 is now determined by the distance of extension of the pins 21 from the surface 11. When the plates have been aligned in this manner, the registration pin 25 is aligned with and extends into the registration opening 45 adjacent the numerical designation "¼". Therefore, in the position shown in FIGS. 7A and 7B, the width of the spool has been adjusted to receive and accommodate a roll of tape or foil having a nominal width of ¼ of an inch.

Figure 8A:
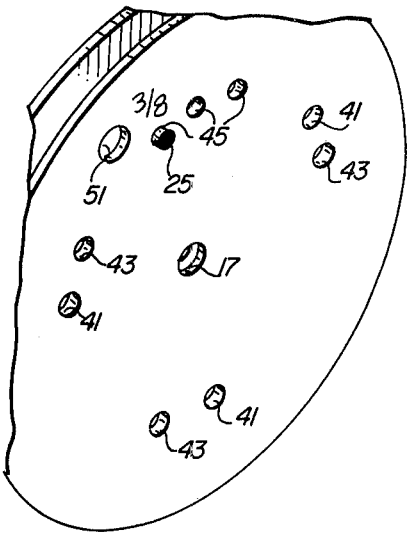
FIGS. 8A and 8B are a perspective view and a cross-sectional view of the adjustable spool of the present invention showing the spool set at a maximum width.
Figure 8B:
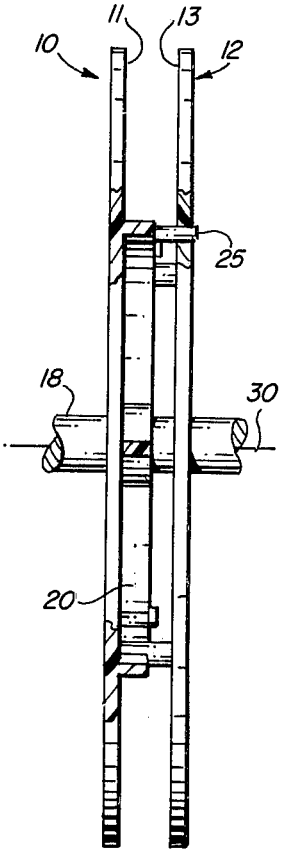

Referring now to FIGS. 8A and 8B, the plates 10 and 12 have again been rotated slightly with respect to each other about the axis 30. It may be seen that the slight rotation has caused the misalignment of all of the spacer pins 21 and 23 with all of the openings 41 and 43 in the plate 12. Thus, none of the spacer pins are aligned with a corresponding opening and the second plurality of spacer pins 23 abutt the surface 13 of the second plate 12. The distance between the plates is thus determined by the distance of extension of the spacer pins 23 from the surface 11. It may be noted that in the position shown in FIGS. 8A and 8B, the registration pin 25 is aligned with and extends into the registration opening 45 adjacent the numerical designation "⅜". Thus, the registration pin extends into a registration opening in every width for which the spool has been designed. In the greatest width, "⅜" inches in the embodiment chosen for illustration, the only elements connecting the two plates 10 and 12 are the registration pin 25 and the cylindrical shaft 18. The registration pin 25 is therefore the only element of the spool that prevents relative rotation between the plates 10 and 12.

A sight opening 51 is provided to permit the operator to observe the amount of tape or foil remaining on the roll positioned between the plates 10 and 12. The plates of the present invention are readily and inexpensively molded of typical plastic materials. The plate 10 is molded integrally with the spacer ring 20 and the pins 21, 23 and 25. The pins are preferably molded as shown in a manner overlying the spacer ring 20. This positioning of the pins provides the function described above relating to the gripping of the roll to be mounted on the spool and also provides the added feature of strengthening the individual pins. That is, the ring 20, having been molded integrally with the pins, effectively support the pins and prevent them from being bent or broken in the event of operator abuse. Another important feature provided by the apparatus of the present invention is the ability of the apparatus to immediately indicate to the operator the chosen width of the spool. In the embodiment chosen for illustration, the registration pin 25 is distinguished from the spacer pins 21 and 23 in any convenient manner such as by providing the tip 50 of the pin with a distinctive color. Alternatively, the cross-section of the pin 25 could be changes to rectangular, triangular, etc. In this manner, the registration pin is immediately distinguishable from the spacer pins. The registration openings 45 may then be designated in any manner such as by placement of a numerical designation adjacent thereto, thus providing an immediate indication to the operator of the chosen width of the spool. While the embodiment chosen for illustration illustrates the utilization of a spool having three predetermined widths, it may be possible to provide many more selected widths. It may therefore become important for the operator to quickly determine the precise width to which the spool has been set to ensure a proper fit of the spool with the tape or foil roll mounted thereon (this latter condition is particularly true in those instances where the variation in width from one standard to the other is very slight).

I claim:

1. An adjustable width spool to be rotatably mounted on a shaft for receiving and supporting a roll of flexible material comprising:

a. a first and a second flat plate having opposing flat surfaces and each having a central opening therein for receiving said shaft to rotatably support said plates;

b. said first flat plate having:

i. a spacer ring positioned concentrically to said shaft and extending a first predetermined distance perpendicularly from the opposing surface of said first flat plate toward the opposing surface of said second flat plate for receiving and supporting said roll of flexible material;

ii. a plurality of spacer pins extending a second predetermined distance greater than said first predetermined distance perpendicularly from its opposing surface toward the opposing surface of said second flat plate;

iii. a registration pin extending a distance greater than said predetermined distances perpendicularly from its opposing surface toward the opposing surface of said second flat plate;

c. said second flat plate having:

i. a plurality of spacer openings corresponding in number to said plurality of spacer pins and positioned to permit said pins to pass through said openings when said pins and openings are aligned;

ii. a plurality of registration openings positioned to permit said registration pin to pass through any of said openings when said registration pin and a registration opening are aligned;

d. said plates positionable in either of two positions relative to each other:

i. the first position defined by abutting contact between said spacer ring and the opposing surface of said second flat plate, by the extension of said spacer pins into said spacer openings, and by the extension of said registration pin into one of said registration openings;

ii. the second position defined by abutting contact between said plurality of spacer pins and the opposing surface of said second flat plate, and by the extension of said registration pin into a different one of said registration openings.

2. The combination set forth in claim 1 wherein all of said pins are positioned the same distance from said central opening measured radially from an axis of said shaft and extend from said spacer ring to assist in the support of said roll of flexible material.

3. The combination set forth in claim 2 wherein the radial distance from the axis of said shaft to the radially most distant surface of said pins is slightly greater than the radial distance to the radially most distant surface of said spacer ring whereby said roll is slightly deformed when placed on said spacer ring.

4. The combination set forth in claim 1 wherein said registration pin in combination with said registration openings provide a designation of the chosen width of said spool.

5. An adjustable width spool to be rotatably mounted on a cylindrical shaft for receiving and supporting a roll of flexible material comprising:

a. a first and a second flat plate having opposing flat surfaces and each having a central opening therein for receiving said cylindrical shaft to rotatably support said plates;

b. said first flat plate having:

i. a spacer ring positioned concentrically to said cylindrical shaft and extending a first predetermined distance perpendicularly from the opposing surface of said first flat plate toward the opposing surface of said second flat plate for receiving and supporting said roll of flexible material;

ii. a first plurality of spacer pins extending a second predetermined distance, greater than said first predetermined distance, perpendicularly from its opposing surface toward the opposing surface of said second flat plate;

iii. a second plurality of spacer pins extending a third predetermined distance, greater than said first and second predetermined distances, perpendicularly from its opposing surface toward the opposing surface of said second flat plate;

iv. a registration pin extending a distance greater than said predetermined distances perpendicularly from its opposing surface toward the opposing surface of said second flat plate;

c. said second flat plate having:

i. a first and a second plurality of spacer openings corresponding in number to said first and second plurality of said spacer pins, respectively, and positioned to permit said pins to pass through said openings when said pins and openings are aligned;

ii. a plurality of registration openings positioned to permit said registration pin to pass through any of said openings when said registration pin and a registration opening are aligned;

d. said plates positionable in any one of three positions relative to each other:

i. the first position defined by abutting contact between said spacer ring and the opposing surface of said second flat plate, and by the extension of said registration pin into one of said registration openings;

ii. the second position defined by the abutting contact between said first plurality of spacer pins and the opposing surface of said second flat plate, and by the extension of said registration pin into a different one of said registration openings; and iii. the third position defined by abutting contact between said second plurality of spacer pins and the opposing surface of said second flat plate, and by the extension of said registration pin into a registration opening differing from the registration opening defining the first or second position.

6. The combination set forth in claim 5 wherein all of said pins are positioned the same distance from said central opening measured radially from an axis of said cylindrical shaft and extend from said spacer ring to assist in the support of said roll of flexible material.

7. The combination set forth in claim 6 wherein the radial distance from the axis of said cylindrical shaft to the radially most distant surface of said pins is slightly greater than the radial distance to the radially most distant surface of said spacer ring whereby said roll is slightly deformed when placed on said spacer ring.

8. The combination set forth in claim 5 wherein said registration pin in combination with said registration openings provides a designation of the chosen width of said spool.

* * * * *